US008506246B2

(12) United States Patent
Geldenhuys

(10) Patent No.: US 8,506,246 B2
(45) Date of Patent: Aug. 13, 2013

(54) STATIC SEAL

(75) Inventor: Siegfried Geldenhuys, Erasmuskloof (ZA)

(73) Assignee: Weir Minerals Africa (Proprietary) Limited, Gauteng (ZA)

( * ) Notice: Subject to any disclaimer, the term of this patent is extended or adjusted under 35 U.S.C. 154(b) by 586 days.

(21) Appl. No.: 12/452,915

(22) PCT Filed: Jul. 24, 2008 (Under 37 CFR 1.47)

(86) PCT No.: PCT/IB2008/052971
§ 371 (c)(1), (2), (4) Date: May 20, 2010

(87) PCT Pub. No.: WO2009/016554
PCT Pub. Date: Feb. 5, 2009

(65) Prior Publication Data
US 2011/0081236 A1 Apr. 7, 2011

(30) Foreign Application Priority Data
Jul. 30, 2007 (ZA) ..... 2007/06298

(51) Int. Cl.
*F04D 29/14* (2006.01)

(52) U.S. Cl.
USPC ..... 415/231; 277/301; 277/426; 415/111

(58) Field of Classification Search
USPC ..... 277/301, 426; 415/111, 169.1, 229, 415/230, 231
See application file for complete search history.

(56) References Cited

U.S. PATENT DOCUMENTS

| | | | | |
|---|---|---|---|---|
| 3,256,027 | A | 6/1966 | Chapel | |
| 3,627,390 | A | 12/1971 | Irwin | |
| 5,078,410 | A | 1/1992 | Warman et al. | |
| 2005/0191170 | A1 * | 9/2005 | Geldenhuys | 415/170.1 |

FOREIGN PATENT DOCUMENTS

| | | | |
|---|---|---|---|
| DE | 4002245 | A1 | 8/1991 |
| DE | 10159638 | A1 | 6/2003 |
| WO | WO 03/040598 | A1 | 5/2003 |

* cited by examiner

*Primary Examiner* — Nathaniel Wiehe
*Assistant Examiner* — Justin Seabe
(74) *Attorney, Agent, or Firm* — Morriss O'Bryant Compagni

(57) ABSTRACT

The static seal (30) includes a rotary seal body (32) comprising an annular base portion (34) which is drivingly mountable on a rotary component such as a shaft and an annular cantilever portion (40) connected at one end to the base portion (34). The seal (30) 5 further includes a rotary seal face (48) and circumferential weights (44) connected to the cantilever portion (40). The seal is configured to dilate under centrifugal force to provide a running clearance between the rotary seal face and a complementary static seal face with which the rotary seal face is in contact when the rotary seal body (28) is stationary. The rotary seal body is further configured so as to facilitate the breaking up of slurry which may set around the seal when the pump (10) of which the seal forms part is inoperative.

17 Claims, 5 Drawing Sheets

STATIC SEAL

Figure 1:
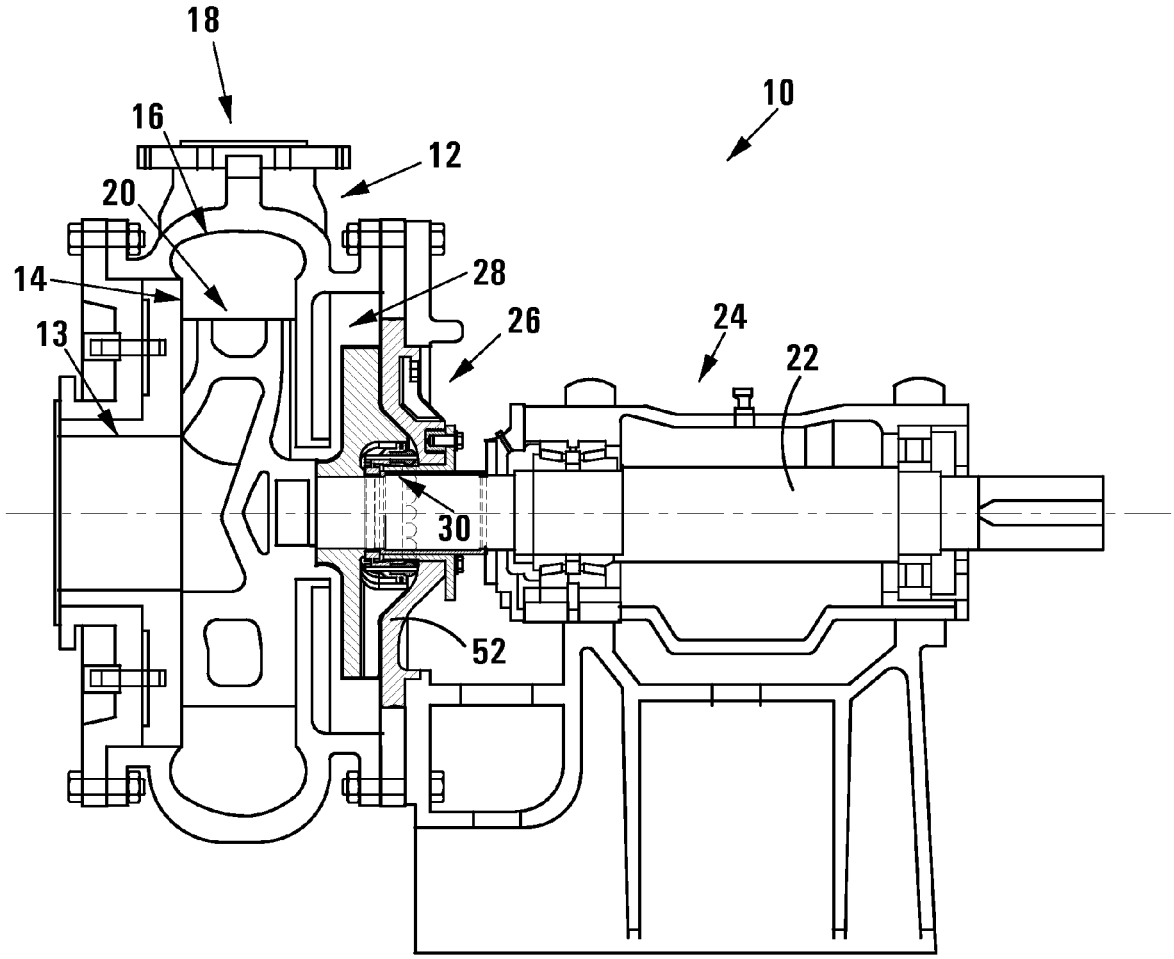

THIS INVENTION relates to a static seal for sealing between rotary and static components of a pump when an impeller of the pump is stationary. It relates also to a pump assembly comprising static and dynamic seals. It further relates to a method of operating a static sealing arrangement.

The kind of static seal to which this invention relates includes a rotary seal body which is mounted on a rotary component, typically on a periphery of a drive shaft. The rotary seal body includes a rotary seal face biased into sealing contact with a complemental static seal face provided as part of the static components, to effect such sealing. When the pump is running, rotation of the shaft rotates the rotary seal body to cause centrifugal force to lift the rotary seal face from the static seal face to provide running clearance.

A rotary seal mechanism is provided to effect sealing when the rotary components are rotating. The static seal and the rotary seal mechanism thus complement each other.

This invention is expected to be particularly advantageously applicable in pumps pumping a settable substance, such as slurry. For purposes of this specification, application to a slurry pump will be emphasized. In such applications, the Applicant has identified it as a problem that the slurry or other settable substance or pumping medium sets or partially sets when pumping has been interrupted. The set or partially set substance then inhibits operation of the static seal, more particularly it inhibits lift-off of the rotary sealing face from the static sealing face, causing sliding or rubbing contact between the sealing faces and thus accelerated wear. This is particularly troublesome in the case of abrasive or highly abrasive pumping media, such as slurry.

This invention relates to a static seal of the following general kind, the static seal including a rotary seal body which is generally annular, having an annular base portion which is drivingly mounted on a rotary component such as a drive shaft mounting an impeller of the pump, and an annular, axially extending, cantilever portion connected at one end to the base portion, an opposed end being unconnected;

a rotary seal face fast with the cantilever portion; and circumferential weights or masses connected to the cantilever portion.

More particularly, in accordance with a first aspect of the invention there is provided a static seal which includes:

a rotary seal body having an annular base portion which is drivingly mountable on a rotary component such as a drive shaft mounting an impeller of a pump, and an annular, axially extending, cantilever portion connected at one end to the base portion, an opposed end of the cantilever portion being unconnected;

a rotary seal face fast with the cantilever portion; and circumferential weights or masses connected to the cantilever portion, the cantilever portion comprising a radially inner sleeve portion and a plurality of body formations fast with the radially inner sleeve portion and divided by grooves or interruptions to render the body formations individual along a radially outer face of the cantilever portion.

In accordance with a second aspect of the invention there is provided a static seal which includes:

a rotary seal body having an annular base portion which is drivingly mountable on a rotary component such as a drive shaft mounting an impeller of a pump, and an annular, axially extending, cantilever portion connected at one end to the base portion, an opposed end of the cantilever portion being unconnected;

a rotary seal face fast with the cantilever portion; and circumferential weights or masses connected to the cantilever portion, the cantilever portion, towards its end connected to the base portion, defining a generally radially outwardly facing oblique or slanted face, diverging toward its unconnected end.

The cantilever portion may comprise a radially inner sleeve portion and a plurality of body formations fast with the radially inner sleeve portion and divided by grooves or interruptions to render the body formations individual along a radially outer face of the cantilever portion.

The slanted face may be a composite face comprising a plurality of such slanted faces, each diverging towards an unconnected end of the respective body formation.

The body formations may be in the form of axially extending, circumferentially arranged, fingers interrupted by the grooves or interruptions which extend axially. The fingers may have rounded radially outer surfaces. The grooves or interruptions may diverge radially outwardly to enhance release of set or partially set material. Radially inner portions of the fingers may be integral with the radially inner sleeve portion.

The cantilever portion may be formed as a moulding of polymeric material.

The base portion may be anchored in a mounting ring for secure drivingly connected seating on a drive shaft, the base portion and the cantilever portion being integrally connected via an annular neck or waist.

In accordance with a third aspect of the invention there is provided a static seal which includes:

a rotary seal body having an annular base portion which is drivingly mountable on a rotary component such as a drive shaft mounting an impeller of a pump, and an annular, axially extending, cantilever portion connected at one end to the base portion, an opposed end of the cantilever portion being unconnected;

a rotary seal face fast with the cantilever portion; and circumferential weights or masses connected to the cantilever portion, the base portion being anchored in a mounting ring for secure, drivingly connected, seating on a drive shaft, the base portion and the cantilever portion being integrally connected via an annular neck or waist.

The base portion may be in the form of a ring, the annular neck or waist extending integrally from an outer surface of the ring for integral connection to one end of the cantilever portion. The base portion, the neck or waist and the cantilever portion may be integral in the form of a moulding of synthetic polymeric material.

The masses may be in the form of elongate mass bodies embedded in the cantilever portion toward the unconnected end of the cantilever portion, each mass body being located on a pin, the mass bodies and pins being integrally moulded at least partially within the cantilever portion.

In accordance with a fourth aspect of the invention there is provided a static seal which includes:

a rotary seal body having an annular base portion which is drivingly mountable on a rotary component such as a drive shaft mounting an impeller of a pump, and an annular, axially extending, cantilever portion connected at one end to the base portion;

a rotary seal face fast with the cantilever portion; and circumferential weights or masses connected to the cantilever portion, the masses being in the form of elongate mass bodies, embedded in the cantilever portion toward the unconnected end of the cantilever portion, each mass body being located on a pin, the mass bodies and pins being integrally moulded at least partially within the cantilever portion which is in the form of a moulding.

The pins may be of a material the density of which is lower than that of the mass bodies to enhance mass concentration toward the unconnected end of the cantilever portion.

The mass bodies may be of heavy metal material, preferably lead, the pins may be of low density metal.

The cantilever portion may comprise a plurality of axially extending, circumferentially arranged, fingers interrupted by grooves or interruptions which extend axially, each finger accommodating a mass body and a pin. Each finger may form a bull nose at the unconnected end of the cantilever portion, the mass bodies having complementally shaped ends, the moulding material of the finger portions wrapping around the corresponding ends of the mass bodies.

The pins may then provide reinforcing within the respective fingers, allowing each finger to rotate or to be deflected in unison, but inhibiting deformation along its length.

The invention extends to a pump assembly including a static pump casing, an impeller and a shaft mounting the impeller and being mounted for rotation within the pump casing, and a composite seal arrangement for sealing between rotary components connected to the shaft and static components connected to the casing, both under stationary and running conditions, in which the composite seal arrangement includes static seal components including a static seal as described above.

The static seal components may include a static sleeve or tube arranged concentrically with running clearance around the shaft, and providing, on a radially outer periphery thereof, an annular static seal face, in the form of a journal, and which is complemental to the rotary seal face of the static seal.

The composite seal arrangement may include a dynamic seal complemental to the static seal, in which the static seal components include a cover sealingly fast with said static seal face and extending obliquely generally radially outwardly and longitudinally to form a hood or cowl having a hood or cowl face at least partially around the static seal, the hood or cowl being curved and defining an annular cavity having said slanting or sloping or oblique face over the static seal, the dynamic seal includes an expeller in the form of a disc drivingly mounted on the shaft, and expeller vanes extending generally radially along and axially proud of the disc, the expeller being positioned axially adjacent the cowl cavity, the expeller vanes being shaped and sized to extend into and to rotate, with running clearance, within said cowl cavity. The vane profile may be complemental to the shape of the cowl cavity.

The vanes may have convexly rounded free edges and concavely rounded corners between the disc and the vanes.

The invention extends further to a method of operating a static sealing arrangement which static sealing arrangement includes a static seal as described above, co-axially fast with a rotor of a pump, and a stationary, circumferential sealing face, co-axially arranged relative to said rotor, and fast with a casing of the pump, the static seal face being complemental to the rotary seal face of the static seal, the method including:

during rotation of the rotor, causing at least part of the cantilever portion of the seal body to dilate radially under the influence of centrifugal force generated by the masses which rotate, to establish a running clearance between the rotary seal face and the static seal face; and when the rotor is stationary, urging the rotary seal face into sealing contact with the static seal face.

When applied to pumping of a settable material such as slurry, the method may include breaking any deposit, which is settled or has partially set around the static seal during a time period when the pump was stationary, by means of dynamic deformation of at least part of the cantilever portion of the seal body.

The dynamic deformation of the seal body may include a torsional deformation.

It will be appreciated, that a static seal in accordance with the invention may be incorporated into a pump assembly as part of the original equipment. Alternatively, the seal could be retrofitted to a pump assembly.

Accordingly, the invention extends still further to a method of retrofitting a static seal of the type described above, into a pump assembly, the method comprising the steps of:

removing an existing seal from the pump assembly; and subsequently, replacing the existing seal with a replacement static seal of the type described above.

Naturally, the existing seal will typically be removed from the pump assembly when it has become worn or as part of a scheduled maintenance program.

Figure 2:
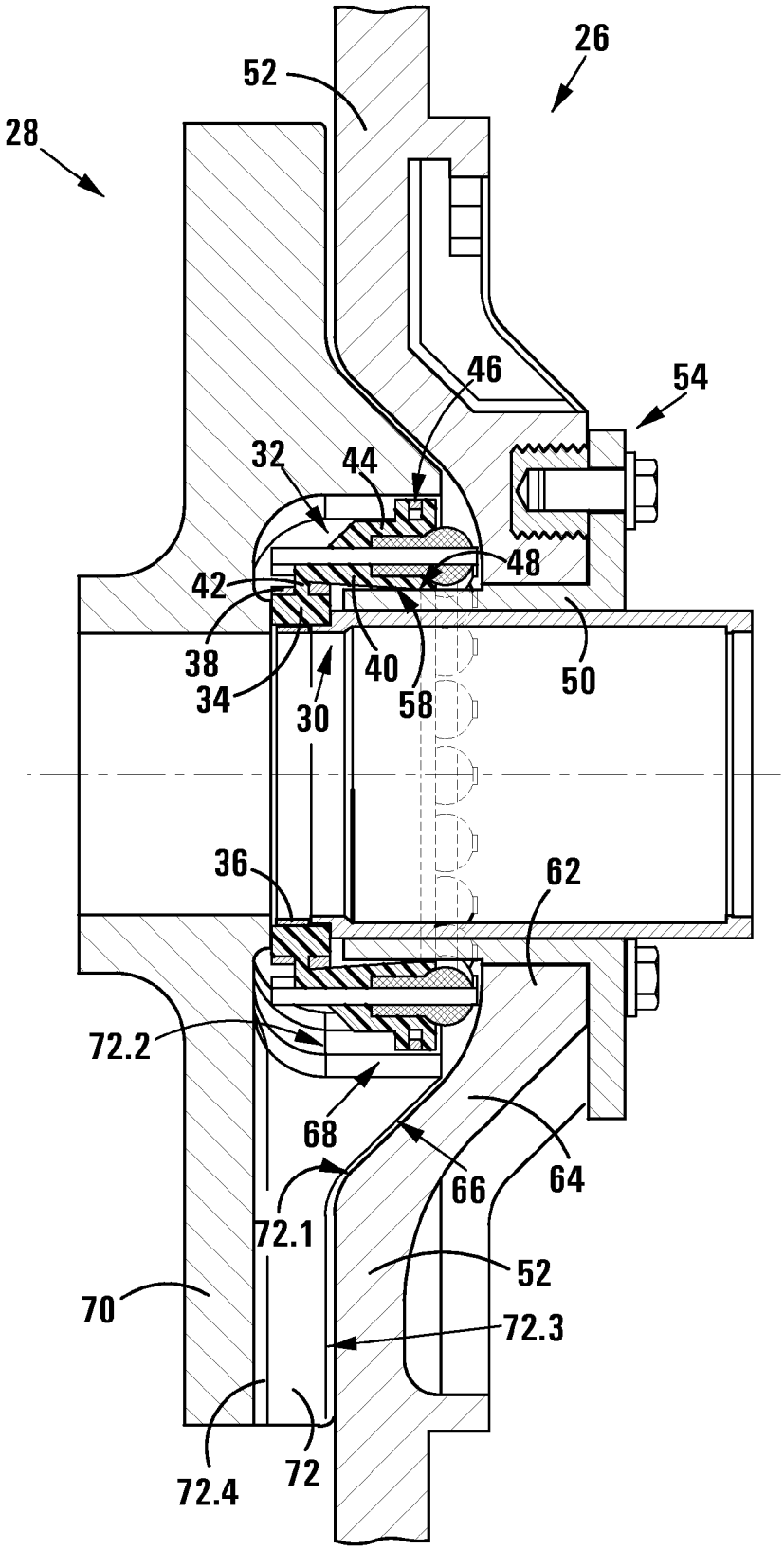
Figure 3:
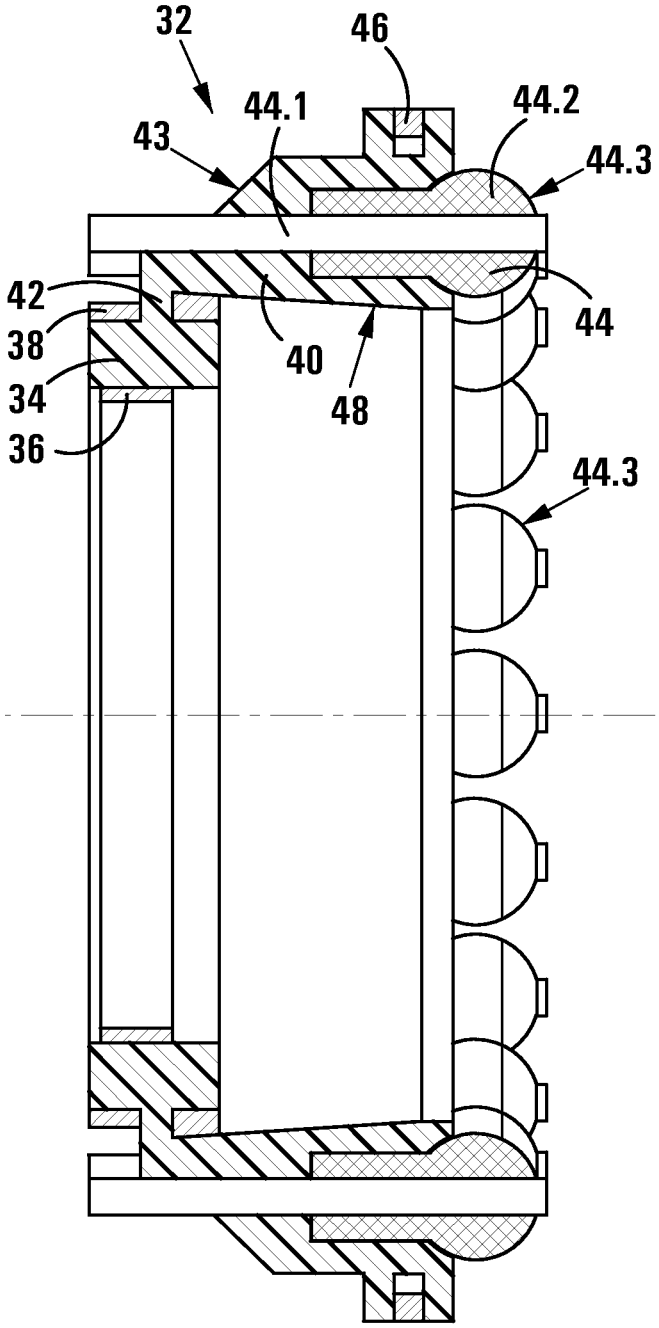
Figure 4:
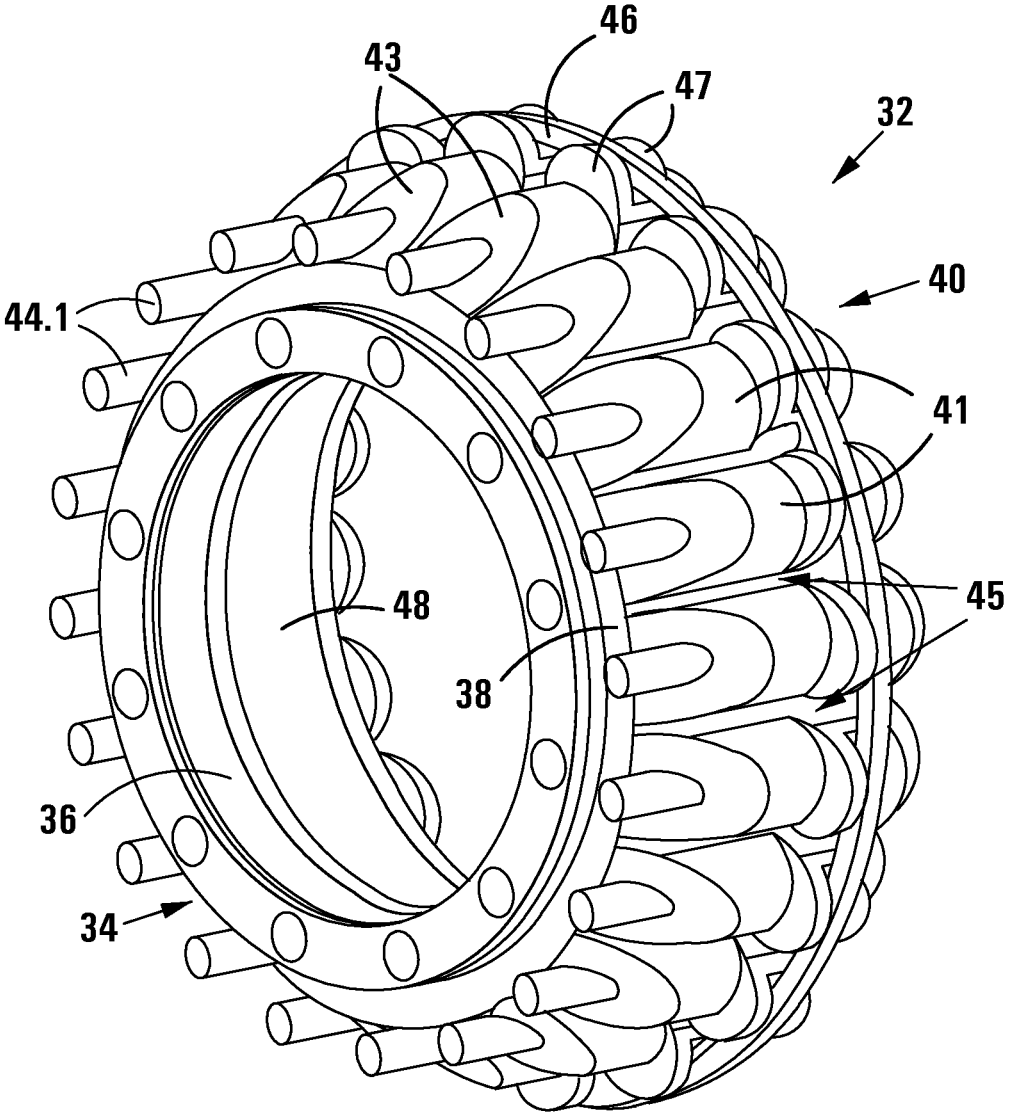
Figure 5:
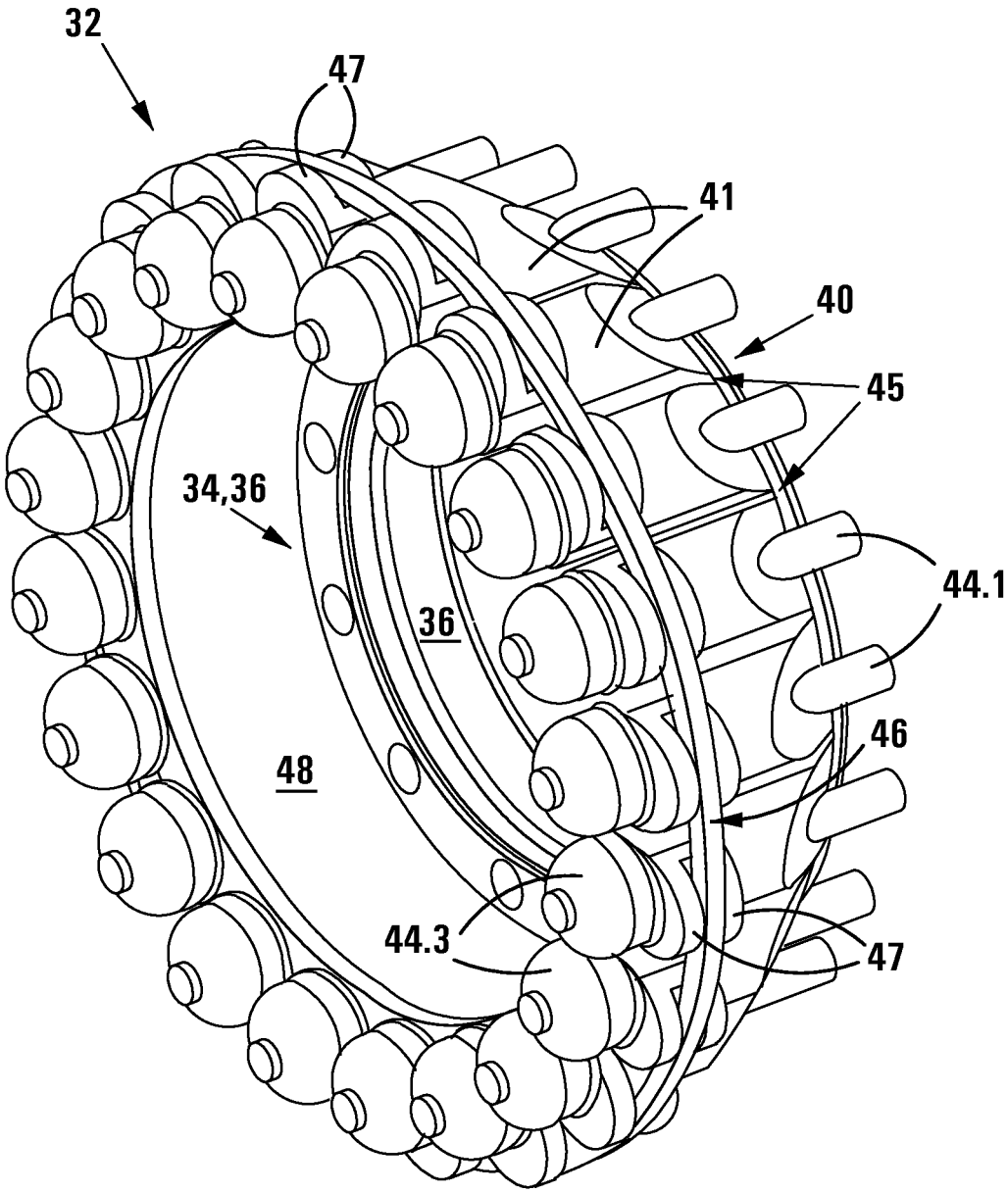

The invention is now described by way of example with reference to the accompanying diagrammatic drawings. In the drawings FIG. 1 shows, in longitudinal section, a pump assembly in accordance with the invention;

FIG. 2 shows, in longitudinal section, to a larger scale, a seal arrangement of the pump assembly of FIG. 1; and FIGS. 3, 4 and 5 show respectively in longitudinal section and in three-dimensional views from opposed sides, a rotary seal body of a static seal forming part of the composite seal arrangement of FIG. 2.

With reference to FIG. 1 of the drawings, a pump assembly in accordance with the invention is generally indicated by reference numeral 10. The pump assembly 10 comprises a static casing 12 having an inlet 13 leading to an impeller cavity 14 which leads into a peripheral volute 16 having an outlet 18. An impeller 20 is mounted cantilever fashion on a shaft 22 supported for rotation in a bearing assembly 24 and being rotatable within the impeller cavity 14.

Referring now also to FIG. 2 of the drawings, the pump assembly 10 comprises a composite sealing arrangement 26 to provide sealing between static and rotary components of the pump assembly 10, more specifically between the shaft 22 (forming part of the rotary components) and a seal cover 52, forming part of the static components of the casing 12. The composite sealing arrangement 26 comprises a dynamic seal 28 and a static seal 30. The dynamic seal 28 and the static seal 30 are complemental in that the dynamic seal arrangement 28 provides sealing between the rotary and static components while the pump assembly 10 is operative i.e. running; and the static seal 30 provides sealing between the shaft 22 and the cover 52 when the pump assembly 10 is stationary.

It is important to appreciate that the pump assembly 10 is a centrifugal pump assembly adapted for operation with a settable working fluid, more specifically slurry. The Applicant has identified it as a particular problem in such working fluids, especially slurry, that the working fluid (slurry) tends to set or set partially if the pump assembly 10 is stopped. Such setting or partial setting of the working fluid (slurry) inhibits start-up of the pump assembly 10, especially in that operation of the static seal is inhibited, as the set or partially set material inhibits or even prevents desired movement of the static seal components to cause lift-off of a rotary seal face from a static seal face to provide running clearance.

With reference to FIGS. 2 to 5, the composite sealing arrangement, and more specifically the static seal 30, are described in more detail.

The static seal 30 has a rotary portion and a static portion. The rotary portion is embodied in a rotary seal body generally indicated by reference numeral 32 and comprising an annular base 34 in the form of a ring which is mounted on the shaft 22 via a drive ring 36. A composite annular support ring 38 is provided outwardly of the base ring 34 to strengthen and stabilize the base ring 34 and specifically also to ensure that start-up torque imparted from the shaft 22 is transmitted with high integrity to the rotary sealing body 32. The ring-shaped base allows contact along the shaft to be sufficiently large to effect sealing with high integrity.

The rotary seal body 32 further comprises a cantilever portion 40 which is nominally in the form of a longitudinally and concentrically extending sleeve secured at one end thereof to the base ring 34, an opposed end being unconnected. As can best be seen in FIG. 3, there is provided an annular neck or waist 42 integral with the base ring 34 and also integral with the corresponding end of the cantilever portion 40. It is to be appreciated that, in this embodiment, and generally preferably, the base ring 34, the neck or waist 42 and the cantilever portion 40 are integral, in the form of a moulding of synthetic polymeric material.

From the neck 42, the cantilever portion 40 extends along a radially inner portion thereof in the form of a sleeve which, along the inner surface, defines a rotary sealing face 48. Along an outer periphery of the cantilever portion 40, as can best be perceived from FIGS. 4 and 5, it is formed by a plurality of longitudinally extending, circumferentially arranged, fingers 41. At the ends of the fingers 41 corresponding to the connected end of the cantilever portion, they define flat, slanted faces 43, and at their opposed ends, they define round bull-nose portions 44.3.

The fingers 41 are divided by longitudinal grooves or interruptions 45. It is to be appreciated that, because the radially outer surfaces of the fingers 41 are rounded, the grooves or interruptions 45 diverge radially outwardly. The significance of this will be commented on below.

Internally of each finger 41, it carries a mass 44 in the form of a mass body 44.2 which, in this embodiment, is of a heavy metal, more specifically of lead. The mass body 44.2 is carried on a longitudinal pin 44.1, at one end standing just proud of the bull nose 44.3 and, at the opposed end, projecting from the face 43. The pins 44.1 are of lightweight metal, e.g. steel, or preferably a metal of lower density than steel. The pins 44.1 and mass bodies 44.2 are integrally moulded within the moulding forming the rotary seal body 32. It is an advantage that the pins 44.1 can be used to locate the mass bodies 44.2 accurately within the mould to ensure that the rotary seal body will be concentric and thus will be in balance.

A limit ring of metal 46 is circumferentially seated around the rotary seal body 32 within seats defined between side formations 47 and forming part of the moulding providing the base 34, neck 42 and cantilever portion 40. The limit ring 46 limits radially outward deformation of the cantilever portion 40 under centrifugal force.

With reference more specifically to FIG. 2, the static portion of the static seal 30 comprises a static tube or sleeve 50 provided concentrically around the shaft 22 with running clearance. The static tube or sleeve 50 has a radially outwardly extending flange by means of which it is secured to the cover 52 by means of circumferentially spaced screw assemblies indicated at 54. As mentioned above, the cover 52 forms part of the static components of the casing 12.

At an outer peripheral surface of the static tube or sleeve 50, it provides a static seal face 58 in the form of a journal.

The rotary seal body 32 is secured via the drive ring 36 to the shaft 22 such that the rotary seal face 48 is axially aligned and concentrically around the static seal face 58.

Operation of the static seal 30 is now briefly described. First, it is to be appreciated that the rotary seal body 32, in the form of a moulding of synthetic polymeric material, is resilient and is biased to cause the rotary seal face 48 sealingly to touch the static seal face 58 to provide sealing between the seal faces. This is the situation when the pump assembly 10 is stationary or inoperative.

When the pump assembly 10 is started and the shaft 22 starts rotating, the rotary seal body 32 is rotated with the shaft 22. Such rotation causes the masses 44 to impart centrifugal force to the rotary seal body. As mentioned above, the cantilever portion 40 is connected at one end only (i.e. in cantilever fashion) thus allowing the unconnected portion to expand or dilate in deformation and to lift the rotary seal face 48 from the static seal face 50 to create a running clearance, and thus to allow running of the pump assembly 10 without sliding or abrasion between the rotary seal face 48 and the static seal face 58. It is to be appreciated that the static seal 30 is not operative as a seal when the pump assembly 10 is running. However, initially, during start-up, it continues to serve a sealing function until the dynamic seal arrangement, to be briefly described hereinafter, can create sealing.

With reference more specifically to FIG. 2, the dynamic seal arrangement 28 comprises a disc 70 secured for rotation concentrically around the shaft 22. To one side, the disc 70 mounts vanes 72 standing longitudinally proud of a corresponding side of the disc 70 and extending generally radially along the disc 70. The vanes 72, when rotating, counteract any leakage from the volute 16 as can best be perceived from FIG. 1. The dynamic seal arrangement 28 operates generally in conventional fashion and its operation as a dynamic seal per se is not described any further.

However, what is of importance is that the vanes 72 do cooperate with features of the static seal 30 adapted to counteract the detrimental effect of setting or partially setting of the working fluid or slurry. In this regard, the cover 52 has an inner base ring 62 to which the static tube or sleeve 50 is secured. From the inner base ring 62, there is an oblique annular portion 64 acting as a hood or cowl to cover the rotary seal body 32 obliquely. The oblique annular portion 64 has a correspondingly oblique inner face 66 defining an oblique cowl cavity 68 around the rotary seal body 32. The vanes 72 of the expeller, in the region of the oblique cowl cavity 68, have a complemental profile indicated by reference numeral 72.1 such that a swept volume of the vanes 72 in that region corresponds to the oblique cowl cavity 68.

Furthermore, radially inner edges 72.2 of the vanes 72 are convexly rounded; side edges 72.3 of the vanes 72 are also convexly rounded, and corners 72.4 between the vanes 72 and the disc 70 are concavely rounded—all to inhibit adherence of setting or partially setting working fluid (slurry) to the expeller vanes.

The invention generally provides, and the illustrated embodiment specifically provides, a plurality of advantages which are especially important in the context of a pump assembly operating with a working fluid, such as slurry, which is prone to setting or partial setting when the pump is stopped. As mentioned above, such set or partially set material inhibits operation of the static seal in that it inhibits free movement or deformation of components of the static seal to allow it to operate as desired.

First, as mentioned above, the rotary seal body 32 has a sturdy, stabilized base ring 34 which seats securely, with high integrity, preferably via a metal drive ring, on the shaft to ensure that relatively high start-up torque which may be required to be imparted to the rotary seal body 32 is transmitted with high integrity. The cover or support ring 38 rigidetize or reinforce the base ring 34, also against centrifugal force when rotating.

Second, the cantilever portion 40 is integrally secured to the base ring 34 by means of a relatively narrow annular neck or waist 42 thus providing high compliance which is conducive to ease of deformation including torsional deformation, especially during start-up. It is to be appreciated that ease of deformation is especially important to deform or crack or dislodge the set or partially set slurry to allow the slurry or other working fluid to be shed and worked away from the proximity of the rotary seal body 32.

It is further to be appreciated that the portions of the pins 44.1 projecting from the oblique faces 43 remain aligned with the fingers, thus causing projections, when they tilt or pivot, to pressurize any set or partially set material in the vicinity of the oblique faces 43. The obliqueness of the faces 43 further promotes ease of deformation or cracking or dislodging of set or partially set material.

It is particularly important that the cantilever portion 40 is solid or continuous only along its inner sleeve portion providing the rotary seal face 48. In the vicinity of its outer peripheral portion, the individual body portions, in the illustrated embodiment in the form of the fingers, are separated by the grooves or interruptions 45, thus greatly enhancing compliance and correspondingly greatly promoting deformation. Furthermore, because of the radially outwardly diverging nature of the interruptions or grooves 45, once set or partially set material is cracked or dislodged, it is released easily. In this regard, it is also to be appreciated that the seats of the limit ring 46 are individualized on each of the body portions or fingers further to prevent a long continuous contact surface with any set or partially set slurry.

It is important that heavy weights are provided to generate centrifugal force. It is particularly important that the weights are concentrated toward the unconnected end of the cantilever portion 40 and are thus remote from the hinge point provided by the neck or waist 42, thus to create an advantageous leverage situation to promote deformation. Even though the deformation is limited in radial direction by the limit ring 46, initial deformation takes place easily which is sufficient to cause deformation, cracking and dislodging of the set or partially set material.

The bull noses further provide spaced aberrations or undulations or stress raisers and prevent a continuous long contact surface with set or partially set working fluid or slurry, to promote dislodging and breaking up of set or partially set material.

The Applicant appreciates that the dimensional integrity of the rotary seal face 48 has to be high to ensure that its basic function i.e. its sealing function can be achieved. In this regard, it is important to appreciate that, in a length-wise direction, the pins 44.1 provide a very important reinforcing function to ensure that the fingers move or are deformed in unison, but without inhibiting deformation under centrifugal force, and without inhibiting angular or twist deformation under torque as is described below.

The Applicant regards it as, possibly, the most important advantage that the cantilever portion is capable of torsional deformation, i.e. it is able to deform angularly or in twist mode at startup under the startup torque. The deformation referred to is caused by torque which causes torque-stress causing angular displacement or twisting of the unconnected end of the cantilever portion relative to the connected end. This is achieved in several ways, e.g. because of the highly compliant neck or waist portion 42 (which is compliant to allow deformation under centrifugal force, and also under torque); the fact that the cantilever portion is solid only along its radially inner portion provided by the radially inner sleeve portion and is unconnected in circumferential direction along its outer portion i.e. because of the individual nature of the body portions, for example the fingers in the illustrated embodiment, which reduces its stiffness against twisting.

A further advantage is that a large space is provided radially outwardly of the rotary seal body 32 in the form of the oblique cowl cavity 68. Furthermore, the intrusion of the shaped or profiled vanes 72 into this region will, first, deform, crack or dislodge and break up any working fluid such as slurry which may have set or partially set in this region, and, secondly, will work such released material back into the general pumping section where it can be dissolved and pumped away with the pumped working fluid. In this regard, it is of importance that the extremities of the vanes are rounded, concavely in some respects and convexly in another respect as described, further to inhibit adherence of set or partially set working fluid such as slurry.

Thus, to sum up, the design of the static seal causes easy deformation of the rotary seal body both under torque and under centrifugal force i.e. in angular deformation or twist and in outward expansion or dilation, to disturb, crack, deform, dislodge and break up any set or partially set material; and further it provides for easy removal of such released material from the vicinity of the static seal. Further, the rotary seal body 32 is stabilized and strengthened or reinforced by means of the pins to protect or ensure the integrity or dimensional stability of the rotary seal face 48 such that its prime function is not detrimentally affected by the ease of deformation in twist and under centrifugal force.

It will be appreciated, that the static seal may have application other than in the pump assembly described above. Consequently, the static seal may be incorporated into a pump assembly other than that described above as part of the original equipment. Alternatively, an existing pump assembly may be modified by replacing an existing seal with the static seal described above. Naturally, this would normally be done when the existing seal becomes worn or alternatively it could be done as part of a planned maintenance program.

The invention claimed is:

1. A static seal comprising:

a rotary seal body having an annular base portion which is drivingly mountable on a rotary component such as a drive shaft mounting an impeller of a pump, and an annular, axially extending, cantilever portion connected at one end to the base portion;

a rotary seal face fast with the cantilever portion; and circumferential weights or masses connected to the cantilever portion, characterised in that the masses are in the form of elongate mass bodies, embedded in the cantilever portion toward the unconnected end of the cantilever portion, each mass body being located on a pin, the mass bodies and pins being integrally moulded at least partially within the cantilever portion which is in the form of a moulding.

2. A static seal as claimed in claim 1, characterised in that the pins are of a material the density of which is lower than that of the mass bodies to enhance mass concentration toward the unconnected end of the cantilever portion.

3. A static seal as claimed in claim 1, characterised in that the cantilever portion comprises a plurality of axially extending, circumferentially arranged, fingers interrupted by grooves or interruptions which extend axially, each finger accommodating a mass body and a pin.

4. A static seal as claimed in claim 3, characterised in that each finger forms a bull nose at the unconnected end of the cantilever portion, the mass bodies having complementally shaped ends, the moulding material of the finger portions wrapping around the corresponding ends of the mass bodies.

5. A static seal as claimed in claim 3, characterised in that the fingers have rounded radially outer surfaces, the grooves or interruptions diverge radially outwardly to enhance release of set or partially set material radially inner portions of the fingers are integral with the radially inner sleeve portion.

6. A static seal as claimed claim 1, characterised in that the base portion is anchored in a mounting ring for secure drivingly connected seating on a drive shaft, the base portion and the cantilever portion being integrally connected via an annular neck or waist, the base portion being in the form of a ring, the annular neck or waist extending integrally from an outer surface of the ring for integral connection to one end of the cantilever portion and the base portion, the neck or waist and the cantilever portion being integral in the form of a moulding of synthetic polymeric material.

7. A static seal as claimed in claim 1, in which the opposed end of the cantilever portion is unconnected and the cantilever portion comprises a radially inner sleeve portion and a plurality of axially extending, circumferentially arranged, fingers fast with the radially inner sleeve portion and divided by grooves or interruptions to render the fingers individual along a radially outer face of the cantilever portion.

8. A static seal as claimed in claim 1, in which the cantilever portion towards its end connected to the base portion defines a generally radially outwardly facing oblique or slanted face, diverging toward its unconnected end.

9. A static seal as claimed in claim 8, characterised in that the slanted face is a composite face comprising a plurality of such slanted faces, each diverging towards an unconnected end of the respective body formation.

10. A pump assembly including a static pump casing, an impeller and a shaft mounting the impeller and being mounted for rotation within the pump casing, and a composite seal arrangement for sealing between rotary components connected to the shaft and static components connected to the casing, both under stationary and running conditions, characterised in that the composite seal arrangement includes static seal components including a static seal, comprising:

a rotary seal body having an annular base portion which is drivingly mountable on a rotary component such as a drive shaft mounting an impeller of a pump, and an annular, axially extending, cantilever portion connected at one end to the base portion, an opposed end of the cantilever portion being unconnected;

a rotary seal face fast with the cantilever portion; and circumferential weights or masses connected to the cantilever portion, characterised in that the cantilever portion comprises a radially inner sleeve portion and a plurality of axially extending, circumferentially arranged, fingers fast with the radially inner sleeve portion and divided by grooves or interruptions to define individual body formations along a radially outer face of the cantilever portion, wherein the masses are in the form of elongate mass bodies, embedded in the cantilever portion toward the unconnected end of the cantilever portion, each mass body being located on a pin, the mass bodies and pins being integrally moulded at least partially within the cantilever portion.

11. A pump assembly as claimed in claim 10, characterized in that the static seal components include a static sleeve or tube arranged concentrically with running clearance around the shaft, and providing, on a radially outer periphery thereof, an annular static seal face, in the form of a journal, and which is complemental to the rotary seal face of the static seal, the composite seal arrangement including a dynamic seal complemental to the static seal, in which the static seal components include a cover sealingly fast with said static seal face and extending obliquely generally radially outwardly and longitudinally to form a hood or cowl having a hood or cowl face at least partially around the static seal, the hood or cowl being curved and defining an annular cavity having said oblique face over the static seal, the dynamic seal including an expeller in the form of a disc drivingly mounted on the shaft, and expeller vanes extending generally radially along and axially proud of the disc, the expeller being positioned axially adjacent the cowl cavity, the expeller vanes being shaped and sized to extend into and to rotate, with running clearance, within said cowl cavity, and the vane profile being complemental to the shape of the cowl cavity, and the vanes having convexly rounded free edges and concavely rounded corners between the disc and the vanes.

12. A method of operating a static sealing arrangement characterised in that the static sealing arrangement includes a static seal comprising a rotary seal body having an annular base portion which is drivingly mountable on a rotary component such as a drive shaft mounting an impeller of a pump, and an annular, axially extending, cantilever portion connected at one end to the base portion, an opposed end of the cantilever portion being unconnected;

a rotary seal face fast with the cantilever portion; and circumferential weights or masses connected to the cantilever portion, characterised in that the cantilever portion comprises a radially inner sleeve portion and a plurality of axially extending, circumferentially arranged, fingers fast with the radially inner sleeve portion and divided by grooves or interruptions to define individual body formations along a radially outer face of the cantilever portion, the masses being in the form of elongate mass bodies, embedded in the cantilever portion toward the unconnected end of the cantilever portion, each mass body being located on a pin, the mass bodies and pins being integrally moulded at least partially within the cantilever portion co-axially fast with a rotor of a pump, and a stationary, circumferential sealing face, co-axially arranged relative to said rotor, and fast with a casing of the pump, the static seal face being complemental to the rotary seal face of the static seal, the method including:

during rotation of the rotor, causing at least part of the cantilever portion of the seal body to dilate radially under the influence of centrifugal force generated by the masses which rotate, to establish a running clearance between the rotary seal face and the static seal face; and when the rotor is stationary, urging the rotary seal face into sealing contact with the static seal face.

13. A method as claimed in claim 12, when applied to pumping of a settable material such as slurry, the method further comprising breaking any deposit, which is settled or has partially set around the static seal during a time period when the pump was stationary, by means of dynamic deformation of at least part of the cantilever portion of the seal body, the dynamic deformation of the seal body including a torsional deformation.

14. A method of retrofitting a static seal into a pump assembly, characterised in that the method comprises the steps of:

removing an existing seal from the pump assembly; and replacing the existing seal with a static seal which comprises a rotary seal body having an annular base portion which is drivingly mountable on a rotary component such as a drive shaft mounting an impeller of a pump, and an annular, axially extending, cantilever portion connected at one end to the base portion, an opposed end of the cantilever portion being unconnected;

a rotary seal face fast with the cantilever portion; and circumferential weights or masses connected to the cantilever portion, characterised in that the cantilever portion comprises a radially inner sleeve portion and a plurality of axially extending, circumferentially arranged, fingers fast with the radially inner sleeve portion and divided by grooves or interruptions to define individual body formations along a radially outer face of the cantilever portion, the masses being in the form of elongate mass bodies, embedded in the cantilever portion toward the unconnected end of the cantilever portion, each mass body being located on a pin, the mass bodies and pins being integrally moulded at least partially within the cantilever portion.

15. A pump assembly including a static pump casing, an impeller and a shaft mounting the impeller and being mounted for rotation within the pump casing, and a composite seal arrangement for sealing between rotary components connected to the shaft and static components connected to the casing, both under stationary and running conditions, characterised in that the composite seal arrangement includes static seal components including a static seal comprising:

a rotary seal body having an annular base portion which is drivingly mountable on a rotary component such as a drive shaft mounting an impeller of a pump, and an annular, axially extending, cantilever portion connected at one end to the base portion;

a rotary seal face fast with the cantilever portion; and circumferential weights or masses connected to the cantilever portion, characterised in that the masses are in the form of elongate mass bodies, embedded in the cantilever portion toward the unconnected end of the cantilever portion, each mass body being located on a pin, the mass bodies and pins being integrally moulded at least partially within the cantilever portion which is in the form of a moulding.

16. A method of operating a static sealing arrangement characterised in that the static sealing arrangement includes a static seal comprising:

a rotary seal body having an annular base portion which is drivingly mountable on a rotary component such as a drive shaft mounting an impeller of a pump, and an annular, axially extending, cantilever portion connected at one end to the base portion;

a rotary seal face fast with the cantilever portion; and circumferential weights or masses connected to the cantilever portion, characterised in that the masses are in the form of elongate mass bodies, embedded in the cantilever portion toward the unconnected end of the cantilever portion, each mass body being located on a pin, the mass bodies and pins being integrally moulded at least partially within the cantilever portion which is in the form of a moulding, co-axially fast with a rotor of a pump, and a stationary, circumferential sealing face, co-axially arranged relative to said rotor, and fast with a casing of the pump, the static seal face being complemental to the rotary seal face of the static seal, the method including:

during rotation of the rotor, causing at least part of the cantilever portion of the seal body to dilate radially under the influence of centrifugal force generated by the masses which rotate, to establish a running clearance between the rotary seal face and the static seal face; and when the rotor is stationary, urging the rotary seal face into sealing contact with the static seal face.

17. A method of retrofitting a static seal into a pump assembly, characterised in that the method comprises the steps of:

removing an existing seal from the pump assembly; and replacing the existing seal with a static seal comprising:

a rotary seal body having an annular base portion which is drivingly mountable on a rotary component such as a drive shaft mounting an impeller of a pump, and an annular, axially extending, cantilever portion connected at one end to the base portion;

a rotary seal face fast with the cantilever portion; and circumferential weights or masses connected to the cantilever portion, characterised in that the masses are in the form of elongate mass bodies, embedded in the cantilever portion toward the unconnected end of the cantilever portion, each mass body being located on a pin, the mass bodies and pins being integrally moulded at least partially within the cantilever portion which is in the form of a moulding.

* * * * *